United States Patent [19]

Ehrsam

[11] 3,996,114

[45] Dec. 7, 1976

[54] ELECTROPLATING METHOD

[75] Inventor: Robert F. Ehrsam, Monroe, Conn.

[73] Assignees: John L. Raymond, Fairfield; Robert Z. Reath, Easton, both of Conn.

[22] Filed: Dec. 17, 1975

[21] Appl. No.: 641,645

[52] U.S. Cl. ..... 204/16; 204/45 R; 204/DIG. 2

[51] Int. Cl.[2] ..... C25D 15/02; C25D 3/02

[58] Field of Search ..... 204/16, 49, DIG. 2, 204/45 R

[56] References Cited

UNITED STATES PATENTS

| | | | |
|---|---|---|---|
| 779,639 | 1/1905 | Case | 204/16 |
| 3,061,525 | 10/1962 | Grazen | 204/9 |
| 3,617,363 | 11/1971 | Metzger | 427/383 |
| 3,844,910 | 10/1974 | Lipp | 204/45 |
| 3,890,209 | 6/1975 | Shigeta | 204/19 |
| 3,891,534 | 6/1975 | Cordone et al. | 310/272 |
| 3,891,542 | 6/1975 | Cordone et al. | 204/16 |
| R12,567 | 11/1906 | Case | 204/16 |

OTHER PUBLICATIONS

Browning, M. E. and Dunkerley, F. J. Electro–Combination Forming of Dispersion–Hardened Alloys. Am. Soc. of Mech. Eng. Paper 65–MO–53.

Williams, R. V. and Martin, P. W. Electro Deposited Composite Coatings, Proceedings 6th Int. Metal Finishing Conference 1964 paper P/17/63.

Sykes, J. M. and Alner, D. J. The Use of Surface Active Agents in Promoting Codeposition of Polymer Particles with Electrodeposited Metal, Trans Inst. of Metal Finishing vols. (1973), pp. 171–172.

*Primary Examiner*—T. M. Tufariello

*Attorney, Agent, or Firm*—Pennie & Edmonds

[57] ABSTRACT

A layer of metal having a plurality of discrete particles of a finely divided solid non-metallic material uniformly dispersed throughout the metal layer is electrodeposited onto the surface of a substrate metal by first applying an amphoteric surfactant having a substituted imidozolinium structure to the surface of the particles of finely divided non-metallic solid material, or by first introducing the said amphoteric surfactant into the electrolyte solution. The said particles and the said metal are then co-deposited onto the substrate metal from an aqueous acidic electrolyte solution containing metalliferous cations of the said metal in solution and the said particles in suspension therein. Specifically, the amphoteric surfactant employed is selected from the group of substituted imidozolinium derivatives having the chemical structure:

$$\overset{|}{CR}{:}NCH_2CH_2\overset{|}{N}(C_2H_4OR^1)(CH_2R^2)(R^3)$$

Where R is a fatty acid radical having from 6 to 18 carbon atoms.

$R^1$ is H, Na or $CH_2COOM$ $R^2$ is COOM, $CH_2COOM$ or $CH(OH)CH_2SO_3M$ $R^3$ is OH

M is H or Na or an organic base.

10 Claims, No Drawings

ELECTROPLATING METHOD

BACKGROUND OF THE INVENTION

1. Field of the Invention

This invention relates to the electrodeposition of composite coatings comprising a layer of electrodeposited metal having small particles of a non-metallic solid material uniformly dispersed throughout said layer.

2. Prior Art

The electrodeposition of a layer of metal on to the surface of a substrate metal has long been employed to enhance or modify such properties of the surface of the substrate as its corrosion resistance, wear resistance, coefficient of friction, appearance and the like. The surface properties of the substrate can be further modified by the electrodeposition of composite layers comprising an electrodeposited metal having discrete particles of a non-metallic material incorporated therein. For example, diamond particles have been incorporated in an electrodeposited metal layer to improve the abrasive or cutting properties of a grinding wheel, particles of such materials as silicon carbide and aluminum oxide have been employed to improve the wear resistance of the electrodeposited metal layer, and particles of such materials as graphite and molybdenum disulfide have been employed to reduce the coefficient of friction of the metal layer. The metal matrix of the composite layer may be any of the metals that are normally electrodeposited from aqueous electrolyte solutions and include such metals as copper, iron, nickel, cobalt, tin, zinc and the like.

The classic procedure for incorporating discrete particles of a non-metallic material in a layer of electrodeposited metal involves allowing the finely divided particles contained in the electrolyte solution to settle onto the generally horizontal surface of a substrate metal onto which surface a layer of a metal is simultaneously being electrodeposited. The layer of electrodeposited metal forms a metal matrix in which the nonmetallic particles are entrapped and thereby physically bonded to the surface of the substrate metal. This general procedure is exemplified by the process disclosed in U.S. Pat. No. 779,639 to Edson G. Case, and modifications thereof are disclosed in Pat. Nos. 3,061,525 to Alfred E. Grazen and 3,891,542 to Leonard G. Cordone et al. In order to promote the co-deposition of non-metallic particles in a electrodeposited metal matrix it has heretofore been proposed that a deposition promoter, usually a surface active agent, be applied to the surface of the finely divided particles of non-metallic material, or be added to the electrolyte solution in which the non-metallic particles are suspended, so that the particles suspended in the electrolyte solution will cling to the surface of the cathode when brought into contact therewith while the metal of the metal matrix is simultaneously being electrodeposited from the electrolyte solution onto the surface of the cathode. This general procedure is exemplified by the process disclosed in U.S. Pat. No. 3,844,910 to Alfred Lipp and Gunter Kratel.

In the Lipp et al process an amino-organosilicon compound, for example, gamma amino-propyl-triethoxy silane, is employed to promote the incorporation of non-metallic particles, for example, silicon carbide, in a layer of electrodeposited metal such as nickel. The amino-organosilicon compound can be added directly to the aqueous electrolyte solution or, preferably, it can be applied to the surface of the non-metallic particles before they are added to the electrolyte solution. In either case the presence of the amino-organosilicon compound in the electrolyte solution results in a substantial increase in the amount of non-metallic particles incorporated in the layer of electrodeposited metal over the amount that is incorporated therein when no such deposition promotor is present in the plating solution. Nonetheless, the Lipp et al process is subject to several operational limitations that limit the usefullness of the process, and the composite coated products of the process, for many purposes. Specifically, the total amount of non-metallic particles (that is, the total weight of the particles) that can be incorporated in the electrodeposited metal coating even under optimum conditions is less than the amount of these particles required for many applications, and in addition there is a practical limit on the size of the particles of non-metallic material that can be usefully employed in the process. That is to say, when the size of the non-metallic particles employed in the Lipp et al process exceeds about 10 microns the amount (that is, the weight) of the non-metallic particles incorporated in the layer of electrodeposited metal tends to decrease in rough proportion to the increase in the average size of the particles.

There is an important and heretofore unfilled need (for example, in the manufacture of grinding wheels) for composite coatings having a greater amount of larger size particles of the non-metallic material in the electrodeposited metal layer than can be produced by any of the prior art processes known to me. Accordingly, I have carried out an intensive investigation of the factors and the problems affecting the production of such coatings, and as a result of my investigation I have discovered that there is a substantial and surprising improvement in the amount and particle size of the non-metallic material in the composite coating when certain amphoteric surfactants are employed as deposition promoters in the process. Specifically, I have found that when certain substituted imidozolinium compounds are employed as deposition promoters in the process, it is possible to incorporate particles of non-metallic material of up to 150 microns or larger in size in the electrodeposited metal matrix without a concommittant decrease in the amount or weight of the particles incorporated therein.

SUMMARY OF THE INVENTION

The present invention relates to the method of electrolytically depositing on the surface of a substrate metal a layer of metal having a plurality of discrete particles of a finely divided solid non-metallic material uniformly dispersed throughout the layer. The metal layer and the particles of non-metallic material are co-deposited on the substrate metal from an aqueous acidic electrolyte solution containing metalliferous ions of the metal being electrodeposited in solution therein and particles of the non-metallic material in suspension therein, the electrolyte solution containing a surface active agent that serves as a deposition promoter for the non-metallic particles and being agitated to maintain the particles uniformly in suspension therein. My improvement in this known procedure comprises employing as the deposition promoter a surface active agent selected from the group having the chemical structure:

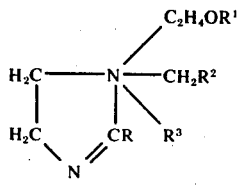

Where R is a fatty acid radical having from 6 to 18 carbon atoms.

$R^1$ is H, Na or $CH_2COOM$ $R^2$ is COOM, $CH_2COOM$ or $CH(OH)CH_2SO_3M$ $R^3$ is OH, and M is H or Na or an organic base The amphoteric surface active may be introduced directly in to the electrolyte solution or, preferably, it may be applied to the surface of the particles of non-metallic material before these particles are introduced into the electrolyte solution. In the latter case, the surface active agent and the particles of non-metallic material are vigorously mixed together with an approximately equal amount of water in a blender or ball mill or the like before being added to the electrolyte solution. The amount of surface active agent employed is advantageously between about 0.5 and 4.0 percent by weight of the amount of non-metallic material present in the solution. Substituted imidazolinium compounds that I have found to be particularly useful in the practice of the invention include:

1-carboxymethoxyethyl-1-carboxymethyl-2-undecyl-2-imidazolinium hydroxide having the structural formula $$N(C_2H_4OCH_2COOH)(CH_2COOH)(OH)C(C_{11}H_{23}):NCH_2CH_2$$

1-carboxymethoxyethyl-1-carboxymethyl-2-heptadecynyl-2-imidazolinium hydroxide having the structural formula $$N(C_2H_4OCH_2COOH)(CH_2COOH)(OH)C(C_{17}H_{31}):NCH_2CH_2$$

and 1-carboxymethoxyethyl-1-carboxymethyl-2-heptyl-2-imidazolinium hydroxide having the structural formula $$N(C_2H_4OCH_2COOH)(CH_2COOH)(OH)C(C_7H_{15}):NCH_2CH_2$$

The use of amphoteric surface active agents having a substituted imidazolinium structure as the deposition promoter for the non-metallic material in the known process for the electrodeposition of composite coatings permits the production of such coatings containing non-metallic particles of up to 150 microns in size and in amounts of about 12 percent by weight or greater. Other advantages of the improved process of the invention will be apparent from the following detailed description thereof.

DETAILED DESCRIPTION

As previously noted it is heretofore been proposed to modify the properties or characteristics, both physical and chemical, of the surface of a metal object by electrodepositing thereon a layer of another metal in which layer are incorporated discrete particles of a finely divided, solid, non-metallic material uniformly dispersed throughout the layer. The elctrodeposited composite coatings are produced by introducing the finely divided non-metallic particles into essentially conventional electroplating baths and maintaining the particles in suspension in the bath while electrodepositing a layer of the metal from the bath onto the surface of a substrate metal in more or less conventional fashion. The layer of electrodeposited metal forms a metal matrix in which some of the non-metallic particles are entrapped and thereby physically bonded to the surface of the substrate metal. The non-metallic particles may be formed from any material that is inert with respect to the electroplating bath (that is, any material that does not react with or is not adversely affected by the plating bath) and that will impart the desired properties or characteristics to the composite electrodeposited layer. Similarly, the metal matrix of the composite layer may be any of the metals that are normally electrodeposited from aqueous electrolyte solutions such as copper, iron, nickel, cobalt, tin, zinc and the like.

It has heretofore been found that the amount or total weight of the finely divided non-metallic particles in the electrodeposited composite coating can be substantially increased by treating the particles with certain surface active agents, and in particular certain cationic surfactants of the type described in U.S. Pat. No. 3,844,910 to Lipp and Kratel. However, as previously noted, these prior processes are limited in that the optimum size of the non-metallic particles that can be incorporated in the electrodeposited composite coating is in the order of 1 to 2 microns, and when the size of the particles exceeds about 10 microns the amount of particles incorporated in the composite coating tends to fall off sharply.

I have now found that when certain substituted imidazolinium compounds are employed as deposition promoters in the process it is possible to incorporate particles of non-metallic material of up to 150 microns or larger in size in the electrodeposited metal matrix of the coating. Specifically, I found that if the non-metallic particles are treated with an amphoteric surface agent selected from the group having the chemical structure

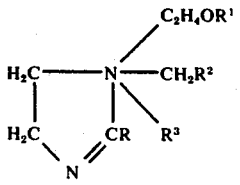

Where

R is a fatty acid radical having from 6 to 18 carbon atoms $R^1$ is H, Na or $CH_2COOM$ $R^2$ is COOM or $CH_2COOM$ or $CH(OH)CH_2SO_3M$ $R^3$ is OH, and M is H or Na or an organic base there is a significant increase in the average particle size and in the total amount of the particles that can be incorporated in the electrodeposited coating.

Amphoteric surface active agents having the above described substituted imidazolinium chemical structure and that have been found to be useful in the practice of my process include but are not limited to: 1-carboxymethoxyethyl-1-carboxymethyl-2-undecyl-2-imidazolinium hydroxide; 1-carboxymethoxyethyl-1-carboxymethyl-2-heptadecynyl-2-imidazolinium hydroxide; 1-carboxymethoxyethyl-1-carboxymethyl-2-heptyl-2-imidazolinium hydroxide; 1-carboxymethoxyethyl-1-carboxymethyl-2-nonyl-2-imidazolinium hydroxide; 1-carboxyethyl-1-carboxymethyl-2-undecyl-2-imidazolinium hydroxide; 1-hydroxyethyl-1-carboxymethyl-2-undecyl-2-imidazolinium hydroxide; 1-carboxymethoxyethyl-1-carboxyethyl-2-undecyl-2-imidazolinium hydroxide; 1-hydroxyethyl-1-sodium sulfonate hydroxyethylmethyl-2-undecyl-2-imidazolinium hydroxide; 1-hydroxyethyl-1-sodium sulfonate hydroxyethylmethyl-2-heptyl-2-imidazolinium hydroxide; and 1-hydroxyethyl-1-sodium sulfonate hydroxyethylmethyl-2-heptadecenyl-2-imidazolinium hydroxide. These amphoteric compounds are available from commercial suppliers, one such supplier being the Miranol Chemical Co., Inc. of Irvington, New Jersey. It should be noted that all of the aforementioned compounds have one or more carboxylic acid radicals in their molecular structure, and each of these compounds can be readily converted to the corresponding sodium salt by reaction with sodium hydroxide or an equivalent sodium compound.

The amphoteric surface active agents employed in the practice of the invention actively promote the incorporation of the finely divided particles of non-metallic material in the coating of the metal being electrodeposited on the surface of the metal substrate, and therefore are referred to herein as "deposition promoters". The mechanism by which these compounds promote the inclusion of the non-metallic particles in the electrodeposited metal matrix is not clearly understood, however, it is undoubtedly at least partly dependent upon the surface active properties of the deposition promoter which enable those particles that chance to come into contact with the surface being electroplated to cling to the surface with sufficient tenacity and for a sufficient period of time to be entrapped in the layer of metal being electrodeposited thereon.

The amphoteric deposition promoter may be incorporated directly in the aqueous plating bath or, preferably, it may first be applied to the surface of the non-metallic particles before these particles are introduced into the bath. In the latter case, the deposition promoter is thoroughly mixed or blended with the particles, advantageously in a high shear blender or in a ball mill, for a sufficient period of time to insure thorough blending of the mixture. The treated particles may then be added directly to the electroplating bath or they can be dried to remove extraneous moisture therefrom before adding to the bath. Both procedures achieve equally satisfactory results. The amount of the amphoteric surfactant employed in the process depends to some extent on the nature of the non-metallic particles being incorporated in the electrodeposited metal matrix. However, I have found that the amount of the deposition promoter should be at least about 0.05% and not more than about 5.0% by weight of the amount of the non-metallic material being treated; and preferably should be between about 0.5% and 3.0% by weight of the non-metallic material.

The specific non-metallic material and the specific electrodeposited metal employed in the production of a particular composite coating depends upon the surface properties required of the composite coating. In addition, the non-metallic material must be physically and chemically inert in respect to the electroplating bath in which the finely divided particles of the material are suspended, and it must be electrolytically inert with respect to the electrolyzing conditions prevailing at the anode and the cathode of the electroplating bath. Apart from these requirements, almost any finely divided solid non-metallic material may be employed in the practice of the invention. For example, but not by way of limitation of the process, finely divided particles of diamonds and of cubic boran nitride have been employed in the production of composite grinding or cutting wheels and other similar tools, finely divided particles of silicon carbide, boron carbide, tungsten carbide, tungsten nitride, tungsten boride, aluminum oxide, tantalum boride and tantalum carbide particles have been employed in the production of both abrasive and wear resistant composite coatings, and finely divided particles of molybdenum disulfide, tungsten disulfide, tungsten diselenide, niobium diselenide, polyfluorethylene and polyvinylchloride have been used in the production of self-lubricating or low friction composite coatings.

The average particle size of the finely divided non-metallic material in the composite coating may, if desired, be smaller than 1 micron in size. However, one of the principal advantages in the use of the above described amphorteric imidazolinium deposition promoters in the practice of the invention is that, contrary to previous experience, particles of from about 5 microns to greater than 150 microns in size can readily be incorporated in electrodeposited composite coatings. More particularly, I have found that when these amphorteric surfactants are employed and when the average particle size of the non-metallic material is within the range of about 5 microns to about 50 microns there is a significant increase in the total amount or weight of the particles that can be incorporated in the electrodeposited composite coating as compared with the amount of similar size particles that can be incorporated in the coating when deposition promoters previously known in the art are used.

The metal matrix of the composite coating is electrodeposited onto the surface of the substrate metal from a conventional electroplating bath (that is, an acidic aqueous solution of ionizable salts of the metal being electroplated) by conventional electroplating techniques, the only important limitation being that the bath not react with nor render ineffective the imidazolinium deposition promoter employed in the process. The electroplating bath must be aqueous; fused salt baths would destroy the organic deposition promoter and organic (non-aqueous) baths would render ineffective its surface active properties. Of the common commercially useful aqueous electroplating baths, I have found that only the hexavalent chromium type of plating bath is unsuitable because of the strong oxidizing powers of the bath that destroy the imidazolinum deposition promoters and because of the gas evolved at the cathode that tends to scour the non-metallic particles from the surface being electroplated. For example, but not by way of limitation, conventional aqueous electroplating baths of the following metals and metal alloys may be employed in the practice of the invention: cadmium, cobalt and cobalt alloys, copper and copper alloys, iron and iron alloys, nickel and nickel alloys, zinc, tin, lead and lead alloys, gold, indium and the platinum group metals.

In the preferred practice of the invention the finely divided solid non-metallic material (for example, silicon carbide) having a particle size of from about 5 to about 50 microns is thoroughly blended with from about 0.5 to 3.0 percent by weight (based on the weight of the non-metallic material) of one or more of the amphoteric imidazolinium deposition promoters described and claimed herein. The treated particles of the non-metallic material are then introduced into a conventional aqueous electroplating bath (for example, a Watts-type nickel electroplating bath) in which are positioned a consumable anode (for example, a nickel anode) and a metal cathode onto the surface of which the composite coating is to be electrodeposited (for example, a steel cathode onto the surface of which a nickel and silicon carbide composite coating is to be deposited). The electroplating bath must be stirred or otherwise agitated to maintain the particles of non-metallic material in suspension therein, but the agitation of the bath cannot be so great as to impede or prevent the lodgement and incorporation of the non-metallic particles in the layer of metal being electrodeposited on the surface of the cathode. The optimum degree of agitation will depend upon the relative densities of the electroplating bath and the non-metallic material in suspension therein, and also on the particle size and the concentration of the non-metallic particles in the bath. For example, but not by way of limitation, I have found that silicon carbide having a particle size within the range referred to above will remain uniformly suspended in a Watts-type electroplating bath without interference with the incorporation of the particles in the electrodeposited metal coating when the agitation of the solution is adjusted to provide a solution flow past the surface of the cathode of between about 0.25 and 0.75 meters per second. The electroplating conditions employed (for example, the bath temperature, current density, etc.) are conventional. The composite coating electrodeposited onto the surface of the cathode comprises a coherent metal matrix throughout which are uniformly distributed discrete particles of the non-metallic material, the coating being characterized by the incorporation therein of a significantly greater amount of larger size particles than heretofore achieved by any prior art process known to me.

The following examples are illustrative but not limitative of the practice of the present invention:

EXAMPLE I

A nickel plating bath was prepared containing 330 grams per liter (g/l) of nickel sulfate ($niSO_4.6H_2O$), 45 g/l of nickel chloride ($NiCl_2.6H_2O$) and 25 g/l of boric acid. The plating solution also contained up to 0.5 g/l sodium saccharine and up to 0.5 g/l napthalene 1,3,6 sulfonic acid sodium salt to adjust the stress of the nickel plate deposit to 5000 psi compressive and 5000 psi tensile as measured by the Brenner Senderoff Spiral Contractometer.

Three liters of the above nickel plating solution were introduced into a suitable vessel together with 180 grams (60 g/l) of untreated silicon carbide having an average particle size of 10 microns, the solution being agitated to maintain the silicon carbide particles in suspension therein. A consumable nickel anode and a stainless steel cathode panel were then placed in the plating solution and the solution agitation was adjusted to provide a solution flow past the cathode panel surface of between 0.25 and 0.75 meters per second. The cathode was electroplated at a current density of about 16 amps per square decimeter (amp/dm$^2$) for a period of 15 minutes at a temperature of 50° C. The plated cathode was then removed from the bath and the percent by weight of silicon carbide in the electrodeposited coating of nickel on the cathode was determined. The coated panel was first weighed to ascertain the total weight thereof, the nickel and silicon carbide coating was then dissolved in nitric acid and the stripped panel was weighed to ascertain the weight of the coating. The acid solution was then filtered to recover the silicon carbide content thereof. The silicon carbide content of the coating thus recovered was then sintered and weighed to ascertain the weight percent of silicon carbide in the coating. In the present example in which no deposition promoter was employed in the electroplating process the coating contained 3.09% by weight silicon carbide.

EXAMPLE II

One hundred and fifty grams of silicon carbide having an average particle size of 10 microns, 150 milliliters(ml) of water and 0.75 gram (0.5% by weight of the SiC) of 1-carboxymethoxyethyl-1-carboxymethyl-2-undecyl-2-imidazolinium hydroxide (Miranol C2M-SF) were mixed in a high shear blender. The mixture of silicon carbide particles, water and amphoteric deposition promoter were blended at high speed for 5 minutes. The thus treated silicon carbide was then added to two and one half liters of the nickel plating bath employed in Example I, and a stainless steel cathode panel was electroplated for 15 minutes under the same conditions as in Example I. The silicon carbide content of the electrodeposited nickel coating was then determined and was found to comprise 5.7% by weight of the coating.

The substantial increase in the amount of silicon carbide present in the electrodeposited nickel coating of Example II as compared with the amount present in the coating of Example I is attributable to the use of the amphoteric deposition promoter (Miranol C2M-SF) in the present example.

EXAMPLE III

A mixture of 150 grams of silicon carbide having an average particle size of 8 microns, 150 ml of water and 0.75 gram of the same deposition promoter (Miranol C2M-SF) employed in Example II was blended at high speed for 5 minutes in a high shear blender. The thus treated silicon carbide was then added to two and one-half liters of the nickel plating bath and a stainless steel cathode was electroplated for 15 minutes under the same conditions as in Example I. The silicon carbide content of the electrodeposited nickel coating was then determined and found to comprise 5.44% by weight of the coating.

EXAMPLE IV

A mixture of 150 grams of silicon carbide having an average particle size of 14 microns, 150 ml of water and 0.75 gram of Miranol C2M-SF was blended at high speed for 5 minutes. The treated silicon carbide particles were recovered and introduced into a nickel plating bath, and a stainless steel cathode was electroplated for 15 minutes as in Example I. The silicon carbide content of the electroplated nickel coating was determined to comprise 11.19% by weight of the coating.

EXAMPLE V

Sixty grams of silicon carbide having an average particle size of 8 microns, 100 ml of water and 0.30 gram (0.5% by weight of the SiC) of 1-carboxymethoxyethyl-1-carboxymethyl-2-heptadecynyl-2-imidazolinium hydroxide (Miranol L2M-SF) were introduced into a 6 liter ball mill employing alundum spheres as the tumbling media. The mixture of silicon carbide, deposition promoter and water was milled for 24 hours and then removed from the ball mill and dried to remove the water therefrom. The thus treated silicon carbide particles were then added to three liters of the nickel plating bath and a stainless steel cathode was electroplated for 15 minutes under the same conditions as employed in Example I. The silicon carbide content of the electrodeposited nickel coating was determined comprise 5.8% by weight of the coating.

EXAMPLE VI

A mixture of 60 grams of silicon carbide having an average particle size of 14 microns 100 ml of water and 0.30 gram of Miranol L2M-SF was milled for 24 hours. The treated silicon carbide particles were recovered, dried and introduced into a nickel plating bath, and a stainless steel cathode was electroplated for 15 minutes as in Example V. The silicon carbide content of the electrodeposited nickel coating was determined to be 9.97% by weight of the coating.

EXAMPLE VII

A mixture of 60 grams of silicon carbide having an average particle size of 8 microns, 100 ml of water and 0.6 gram of Miranol C2M-SF (comprising 1% by weight of the silicon carbide) was milled for 24 hours and the treated silicon carbide) was milled for 24 hours and the treated silicon carbide particles were recovered and dried as in Example V. The silicon carbide particles were then added to a nickel plating bath and a stainless steel cathode was electroplated for 15 minutes as in Example I. The silicon carbide content of the electrodeposited nickel coating was estimated to comprise 8.7% by weight of the coating.

EXAMPLE VIII

A mixture of 60 grams of silicon carbide having an average particle size of 8 microns, 100 ml of water and 1.20 grams of Miranol C2M-SF (comprising 2% by weight of the silicon carbide) was milled for 24 hours and the treated silicon carbide particles were recovered and dried as in Example V. The silicon carbide particles were then added to a nickel plating bath and a stainless steel cathode was electroplated for 15 minutes as in Example I. The silicon carbide content of the electrodeposited nickel coating was estimated to comprise 9.1% by weight of the coating.

EXAMPLE IX

A mixture of 60 grams of silicon carbide having an average particle size of 8 microns, 100 ml of water and 1.20 grams of 1-carboxymethoxyethyl-1-carboxymethyl-2-heptyl-2-imidazolinium hydroxide (Miranol J2M-SF) was milled for 24 hours and the treated silicon carbide particles were recovered and dried as in Example V. The dried silicon carbide particles were then introduced into a nickel plating bath and a stainless steel cathode was electroplated for 15 minutes as in Example I. The silicon carbide content of the electrodeposited nickel coating was estimated to comprise 7.5% by weight of the coating.

EXAMPLE X

A mixture of 150 grams of silicon carbide having an average particle size of 8 microns, 150 ml of water and 4.5 grams of Miranol C2M-SF (comprising 3% by weight of the silicon carbide) was blended at high speed for 5 minutes. The treated silicon particles were recovered and were introduced into a nickel plating bath, and a stainless steel cathode was electroplated for 15 minutes as in Example I. The silicon carbide content of the electrodeposited nickel coating was determined to comprise 4.82% by weight of the coating.

EXAMPLE XI

A copper plating bath was prepared containing 240 g/l cupric sulfate, 12 g/l sulfuric acid and 0.0075 g/l thiourea. Three liters of the copper plating solution were introduced into into an electroplating vessel together with a consumable copper anode and a stainless steel cathode panel. One hundred eighty grams of silicon carbide having an average particle size of 8 microns, 180 ml of water and 1.0 gram of Miranol C2M-SF were blended together for 5 minutes in a high shear blender as in Example II. The treated silicon carbide particles were then added to the copper plating solution in the electroplating vessel, and the solution agitation was adjusted to provide solution flow of between 0.25 and 0.75 meters per second past the surface of the cathode panel. The cathode panel was electroplated at a current density of about 15 amps/dm$^2$ and at a temperature of about 25° C for a period of 15 minutes. The silicon carbide content of the electrodeposited copper coating was determined to comprise 0.83% by weight of the coating.

EXAMPLE XII

Two and one-half liters of an iron plating bath containing 300 g/l ferrous chloride and 335 g/l calcium chloride was introduced into an electroplating vessel in which vessel were positioned a consumable iron anode and a brass cathode panel. One hundred fifty grams of silicon carbide having an average particle size of 8 microns, 150 ml of water and 0.75 grams of Miranol C2M-SF were blended together for 5 minutes in a high shear blender as in Example II. The treated silicon carbide particles were added to the iron plating solution and the agitation of the solution was adjusted to provide solution flow of about 0.25 meter per second past the surface of the cathode panel. The cathode was electroplated at a current density of about 15 amps/dm$^2$ and a temperature 90° C for 15 minutes. The silicon carbide content of the electrodeposited iron coating was estimated to be 4.6% by weight of the coating.

EXAMPLE XIII

Two and one-half liters of a zinc plating bath containing 240 g/l zinc sulfate, 15 g/l sodium chloride, 22 2/l boric acid and 30 g/l aluminum sulfate was introduced into an electroplating vessel in which vessel were positioned a consumable zinc anode and a brass cathode panel. One hundred fifty grams of silicon carbide having an average particle size of 8 microns, 150 ml of water and 0.75 gram of Miranol C2M-SF were blended together for 5 minutes as in Example II. The treated silicon carbide particles were added to the zinc plating solution and the cathode was electroplated at a current density of about 15 amps/dm$^2$ and a temperature of 45° C for 15 minutes. The silicon carbide content of the electrodeposited zinc coating was estimated to be 2.8% by weight of the coating.

I claim:

1. In the method of electrolytically depositing on the surface of a substrate metal a layer of a metal having a plurality of discrete particles of a finely divided solid non-metallic material uniformly dispersed throughout said layer, said metal layer and said particles being co-deposited from an aqueous acidic electrolyte solution containing said metal in solution and said particles in suspension therein, said electrolyte solution containing a surface active agent desposition promoter for the non-metallic, and being agitated to maintain the particles uniformly in suspension therein, the improvement which comprises employing as said deposition promoter a surface active agent selected from the group having the chemical structure:

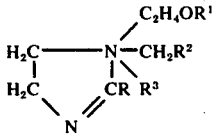

Where

R is a fatty acid radical having from 6 to 18 carbon atoms.

$R^1$ is H, Na or $CH_2COOM$ $R^2$ is COOM, $CH_2COOM$ or $CH(OH)CH_2SO_3M$ $R^3$ is OH, and M is H or Na or an organic base

2. The method according to claim 1 in which the surface active agent and the particles of non-metallic material are vigorously mixed together with an approximately equal amount of water prior to being introduced into the aqueous electrolyte solution.

3. The method according to claim 1 in which the surface active agent is 1-carboxymethoxyethyl-1-carboxymethyl-2-undecyl-2-imidazolinium hydroxide having the structural formula $$N(C_2H_4OCH_2COOH)(CH_2COOH)(OH)C(C_{11}H_{23}):NCH_2CH_2$$

4. The method according to claim 1 in which the surface active agent is 1-carboxymethoxyethyl-1- carboxymethyl-2-heptadecynyl 2-imidazolinium hydroxide having the structural formula $$N(C_2H_4OCH_2COOH)(CH_2COOH)(OH)C(C_{17}H_{31}):NCH_2CH_2$$

5. The method according to claim 1 in which the surface active agent is 1-carboxymethoxyethyl-1-carboxymethyl-2-heptyl-2-imidazolinium hydroxide having the structural formula $$N(C_2H_4OCH_2COOH)(CH_2COOH)(OH)C(C_7H_{15}):NCH_2CH_2$$

6. The method according to claim 1 in which the finely divided non-metallic material has a particle size of from about 1 to 150 microns.

7. The method according to claim 1 in which the finely divided non-metallic material has a particle size of from about 5 to about 50 microns.

8. The method according to claim 1 in which the amount of the surface active deposition promoter employed comprises from about 0.05 to about 5.0 percent by weight of the amount of the finely divided non-metallic material.

9. The method according to claim 1 in which the amount of the surface active deposition promoter employed comprises from about 0.5 to about 3.0 percent by weight of the amount of the finely divided non-metallic material.

10. The method according to claim 1 in which the agitation of the electroplating bath is adjusted to provide a solution flow of between about 0.25 and 0.75 meters per second past the surface of the cathode.

* * * * *